United States Patent [19]

Zeuner et al.

[11] Patent Number: 4,649,956

[45] Date of Patent: Mar. 17, 1987

[54] PROPORTIONAL FOLLOWER SPOOL VALVE SYSTEM

[75] Inventors: Kenneth W. Zeuner, New Hope; Steven K. Zeuner; Thomas A. Zeuner, both of Holland, all of Pa.

[73] Assignee: Zeuner Enterprises, Inc., New Hope, Pa.

[21] Appl. No.: 773,516

[22] Filed: Sep. 5, 1985

Related U.S. Application Data

[63] Continuation of Ser. No. 511,576, Jul. 7, 1983, abandoned.

[51] Int. Cl.[4] ..... F15B 13/043

[52] U.S. Cl. ..... 137/625.63; 137/625.64

[58] Field of Search ..... 137/625.61, 625.62, 137/625.63, 625.64

[56] References Cited

U.S. PATENT DOCUMENTS

| | | | |
|---|---|---|---|
| 734,285 | 7/1903 | Thomann | 137/625.63 |
| 2,526,709 | 10/1950 | Tait | 137/625.63 |
| 2,600,348 | 6/1952 | Walthers | 137/625.6 |
| 2,655,939 | 10/1953 | Tauscher et al. | 137/625.63 |
| 2,655,940 | 10/1953 | Jackson | 137/625.63 |
| 3,060,969 | 10/1962 | Aslan | 137/625.63 |
| 3,089,517 | 5/1963 | Ludwig | 137/625.63 |
| 3,114,394 | 12/1963 | Panissidi | 137/625.64 |
| 3,152,614 | 10/1964 | Carls | 137/625.69 |
| 3,530,895 | 9/1970 | Rothrock | 137/625.63 |

FOREIGN PATENT DOCUMENTS

| | | | |
|---|---|---|---|
| 2445053 | 4/1976 | Fed. Rep. of Germany | 137/625.63 |
| 2456765 | 6/1976 | Fed. Rep. of Germany | 137/625.63 |
| 2506864 | 8/1976 | Fed. Rep. of Germany | 137/625.64 |

*Primary Examiner*—Gerald A. Michalsky
*Attorney, Agent, or Firm*—Ratner & Prestia

[57] ABSTRACT

A proportional follower spool valve system having a main spool slidable between end chambers maintained at substantially return pressure. First fluid connections are controlled by the main spool and they are effective to control output fluid flow in accordance with the position of the main spool. A pilot spool is slidable within an inner passage of the main spool. A first and a second driving chamber is formed by the main spool each having a driving area substantially less than the largest cross-sectional solid area of the main spool. Second fluid connections are controlled by the pilot spool for admitting fluid under pressure (1) to the first chamber when the pilot spool moves in a first direction away from the first chamber and (2) to the second chamber when the pilot spool moves in a second direction away from the second chamber. Each of the first and second driving chambers are disposed between a respective end chamber and a passage for return pressure.

11 Claims, 6 Drawing Figures

PROPORTIONAL FOLLOWER SPOOL VALVE SYSTEM

This application is a continuation of application Ser. No. 511,576 filed July 7, 1983, now abandoned.

BACKGROUND OF THE INVENTION

A. Field of the Invention

This invention relates generally to the field of servo follower proportional control spool valves.

B. Background Art

Servo follower proportional control valves are well known in the art and are generally described in 1980–81 Fluid Power Handbook and Directory, page A-141 and in National Conference on Fluid Power, 1976 *Electro-proportional Position Controls—An Analysis for Application on Various Hydraulic Control Functions* by D. W. Swaim.

Prior proportional control valves have left much to be desired with respect to rapid response to input commands which may be rapidly changing. In prior spool valves, such rapid response was adversely affected by the use of dynamic seals. The seals would enter the space between the bore and the active valve element and thus increase friction. In this way, such seals were known to cause breakaway and running friction between the valve element and bore, thereby decreasing the ability to rapidly respond as well as decreasing ion frequency tracking ability.

Another objectionable feature of prior proportional control valves decreasing rapid response has been the relatively large driving chamber volume. The large chambers required a relatively large amount of fluid to produce movement, which in turn required a substantial ammount of time. For example, see U. S. Pat. Nos. 2,526,709; 2,555,755; and 4,085,920.

Many prior proportional valves are of the electrohydraulic type which have flapper nozzles and which produce valve spool movement. The following are representative patents directed to such flapper nozzle valves: 3,874,405; 3,598,151; 3,598,152; 3,742,980; 3,457,956; and 3,749,128. In these systems a DC electrical signal to the coils of the pilot stage of a force-balanced torque motor develops a torque moving the armature-flapper either clockwise or counter clockwise between the nozzles. This movement restricts flow out of one of the nozzles and eases flow out of the other with the pressure unbalance driving the spool. These flapper-nozzle proportional valves have left much to be desired as a result of the constant leakage of the valve including the time when the valve is at null. This leakage at null is a serious disadvantage since the valve may be at null for a long period of time and would lose a substantial amount of energy, as for example a quarter to four-tenths of a gallon per minute per valve. For multiple valves the loss has been considerable and has required cooling members to remove the lost energy. Another problem with flapper-nozzle proportional valves has been in their small orifices to control the flapper as well as small spring feedback. The small orifices are liable to clogging and the small springs are liable to fatigue. Spool proportional valves suffer from similar problems as they also have small orifices and high null leakage. In such valves the leakage at null undesirably increases as flow increases. See U.S. Pat. No. 3,827,453. The following are examples of patents on spool within spool valves: U.S. Pat. Nos. 3,027,880, 2,748,752; 3,530,895; 3,163,179; 4,114,650; 3,013,539; 3,459,224; and 4,046,059.

SUMMARY OF THE INVENTION

A proportional follower spool valve system which provides output fluid flow proportional to a positional control. The system includes a main spool having an inner passage and a pilot spool which is slidable in the passage. First fluid connections are controlled by the main spool and they are effective to control output fluid flow in accordance with the position of the main spool. The pilot spool is moved from a null position with the main spool in either a first or second direction and in accordance with the positional control. First and a second driving chambers are formed by the main spool each having a driving area substantially less than the largest solid cross-sectional area of the main spool. Second fluid connections are controlled by the pilot spool for admitting fluid under pressure (1) to the first chamber when the pilot spool moves in the first direction away from the first chamber and (2) to the second chamber when the pilot spool moves in the second direction away from the second chamber. In this manner, the main spool is moved in the same direction as the pilot spool until a null position is reached.

Further in accordance with the invention, the main spool is slidable in a main passage having end chambers maintained at substantially return pressure. Each of the first and second driving chambers are disposed between a respective end chamber and return pressure thereby to avoid dynamic seals on the main spool.

DETAILED DESCRIPTION OF THE INVENTION

Figure 1:
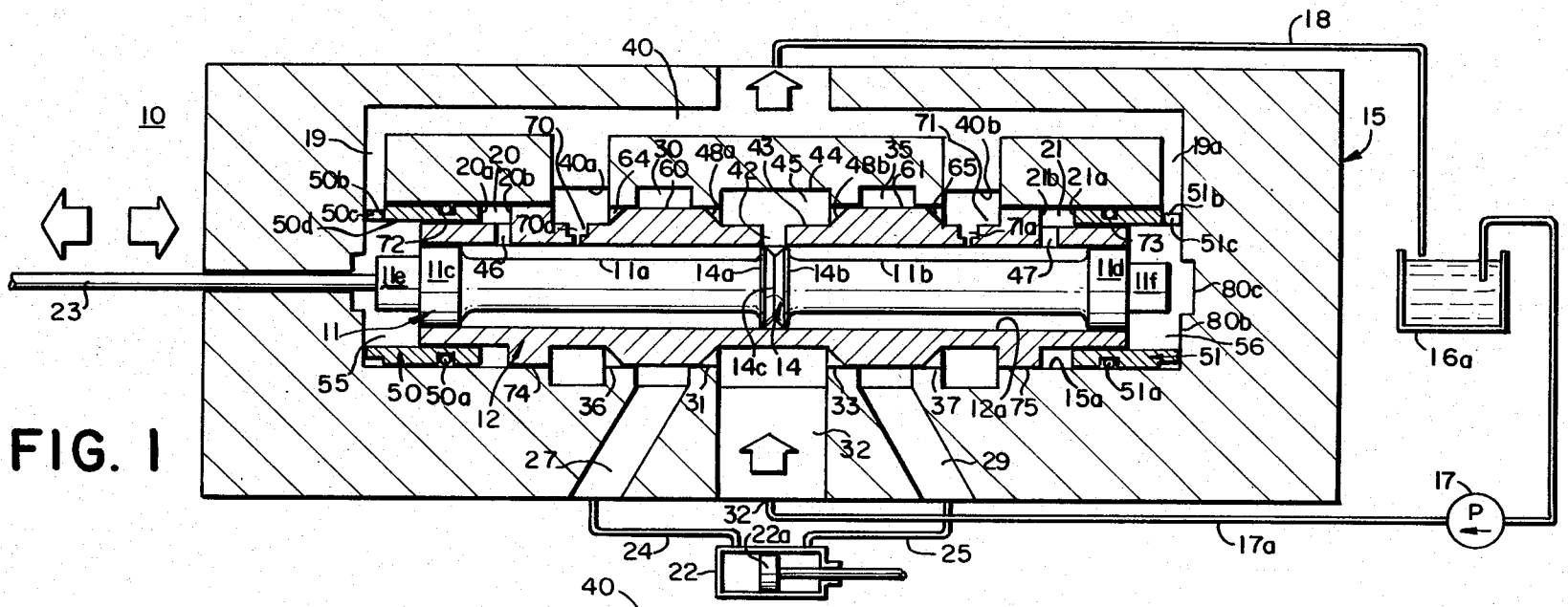
FIGS. 1–4 are detailed, elevational sectional views of a proportional follower spool valve system of the present invention.

Referring now to FIG. 1 there is shown a servo follower proportional control spool valve 10 which comprises a housing 15 having a cylindrical bore 15*a* for slidably receiving a main spool 12. The main spool has an open bore 12*a* for slidably receiving a pilot spool 11. Valve 10 may be coupled to a pump 17 for pumping hydraulic fluid from a sump 16*a* through an inlet line 17*a* to an inlet passage 32 of valve 10.

A fluid operated actuator operated by valve 10 may be a piston 22*a* operating in a cylinder 22. One end of cylinder 22 is connected through a line 24 to an outlet cylinder passage 27 of valve 10. The opposite end of cylinder 22 is similarly connected through another line 25 to another outlet cylinder passage 29. The load (not shown) may be coupled to the shaft of piston 22*a* in conventional manner. Further valve 10 has a return passage 40 which is connected through a return line 18 back to sump 16*a*.

Main spool 10 has cylindrically lands 60, 61, 67 and 68 spaced axially with respect to longitudinal axis 16. Chamfered main flow metering grooves or passages 64, 48*a* are formed on the left and right sides of land 60 and similar main flow metering grooves 48*b*, 65 are formed on the left and right sides of land 61. Grooves 48*a,b* extend downwardly into spool 12 to define a cylindrical pressure groove or recess 43. A transverse inlet metering orifice 42 extends between groove 43 and bore 12*a* in main spool 12. A cylindrical tank groove or recess 70 is formed between main flow metering groove 64 and land 67 with a restricted orifice 70*a* formed between groove 70 and bore 12*a*. Similarly, a cylindrical tank groove 71 is formed on spool 12 between groove 65 and land 68 with a restricted orifice 71*a* defined between groove 71 and bore 12*a*. Land 67 extends into a reduced diameter cylindrical section 72 which defines the left end of main spool 12 while land 68 extends into reduced diameter section 73 which defines the right end of spool 12. Connecting passages 46, 47 are formed transverse of axis 16 and provide connecting passages between bore 12*a* and chambers formed by the outer surfaces of sections 46, 47 respectively.

Lands 60, 61, 67 and 68 on main spool 12 are slidably but sealingly received in cylindrical bore 15*a*. This bore presents a cylindrical land surface 31 disposed between annular recess 30 leading to cylinder passage 27 and annular pressure recess 44 leading to pressure inlet passage 32. Similarly, cylindrical land surface 33 of bore 15*a* is disposed between annular recess 35 which leads to cylinder passage 29 and pressure recess or cavity 44. In the spool 12 position shown in FIG. 1, recesses 43, 44 form an annular pressure chamber 45. Further, bore 15*a* presents cylindrical land surfaces 36 and 37. Land 36 is disposed between recess 30 and an annular return recess 40*a* and land 37 is disposed between recess 35 and return recess 40*b*. Return recesses 40*a,b* lead to return passage 40 and form annular return chambers with recesses 70, 71 respectively in the spool 12 neutral position.

At its left end, bore 15*a* forms an elongated end recess 74 for receiving land 67 and a floating annular spacer 50 which abuts an end wall of end cap 78. Spacer 50 has its inner cylindrically shaped bore surface 50*d* ground to receive the outer surface of section 72. A slot is formed on the outer surface of spacer 50 to provide for an O-ring 50*a* for sealing engagement between the spacer and recess 74. It is in this manner that spacer 50 is effective to "float" within recess 74. In addition an annular slot 50*b* leading to return passage 19 is undercut at the left end of spacer 50 which slot is coupled by way of a passage 50*c* to end chamber 55 formed by the inner bore of spacer 55 and wall 78*b*. In this manner end chamber 55 is referenced to tank. Wall 78*b* is formed by a left end cap 78 which threadedly engages housing 15 to seal the bore 15*a* by way of an O-ring 78*a*. A left end driving chamber 20 is formed by a right wall 20*a* of spacer 50, a left wall 20*b* of land 67 and the upper surface of section 72. The purpose and operation of driving chamber 20 will later be described in detail.

It will be understood that the components as shown within and adjacent to right end recess 75 of bore 15*a* are similar to those described with respect to recess 74 and need not be further described in detail. These components comprise floating spacer 51, O-ring 51*a*, annular slot 51*b*, passage 51*c*, right wall 80*b*, return passage 19*a*, chamber 56 and right end driving chamber 21.

Figure 3:
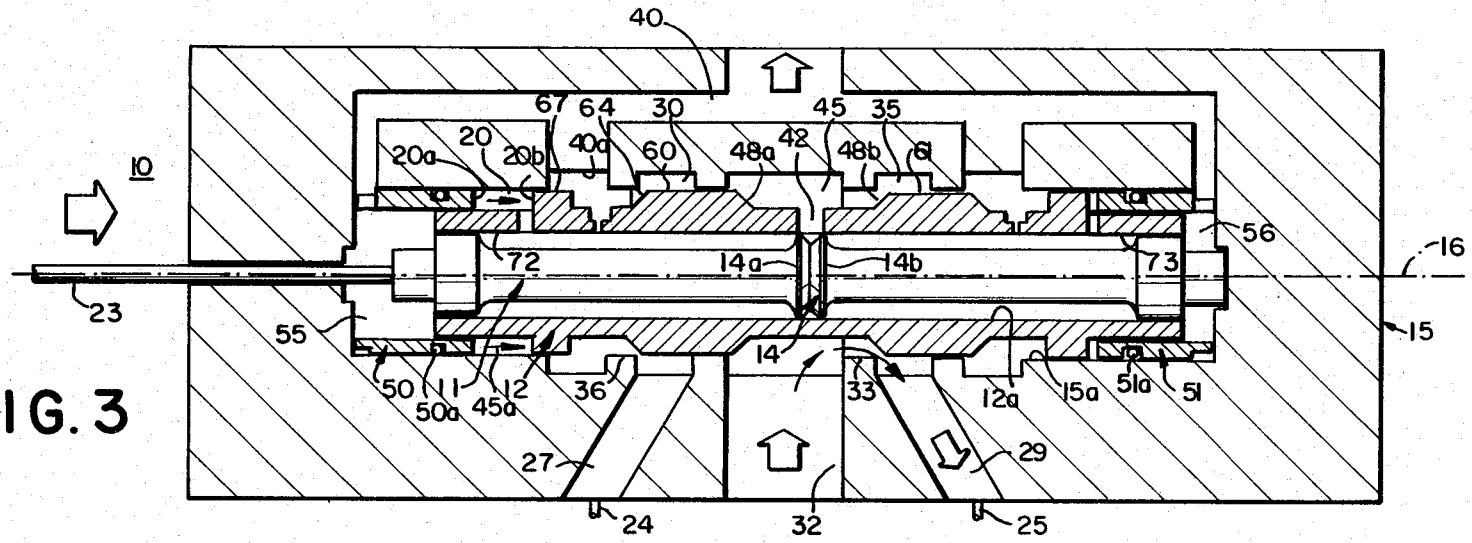

As previously described pilot spool 11 is received within bore 12*a* of spool 12. Spool 11 has at its center a V-groove piston 14 defined by a pair of metering lands 14*a, b* where the V-groove 14*c* is formed between the lands. In the null position of spool 11 with respect to spool 12 as shown in FIGS. 1, 3, V-groove 14*c* is in communication with metering orifice 42. Metering lands 14*a, b* each form a sharp metering edge with a respective wall of orifice 42 and sealingly engage bore 12*a* so that there is no flow of fluid from orifice 42 into the left or right side of bore 12*a*. Spool 11 also has two axially spaced cylindrical lands 11*c, d* formed at the left and right ends of the spool to sealingly engage the left and right ends of open bore 12*a* in all positions of spool 11. Metering land 14*a* and land 11*c* are integrally interconnected by stem portion 11*a* which defines an elongated longitudinally directed annulus forming a longitudinal passage which extends almost one-half of the length of spool 11. Similarly, stem portion 11*b* interconnects a metering land 14*b* and land 11*d* with an elongated longitudinal annulus forming a passage extending almost half the length of spool 11. Passage 11*a* leads through to passage 46 and to orifice 70*a* while passage 11*b* leads through to orifice 71*a* and to passage 47. The left end of spool 11 terminates in an end portion 11*e* which is adapted to engage a stop 78*c* of end cap 78. Similarly, a right end portion 11*f* of spool 11 is adapted to engage a stop 80*c* of right end cap 80. To provide axial movement of pilot spool 11, there is provided an actuator 23 which is rigidly connected as shown through the center of left end portion 11*e* to the left section of spool 11. Actuator 23 extends through chamber 55 and through the axis of end stop 78 and in sealing relation thereto.

In operation, in the position shown in FIG. 1, spools 11 and 12 are in their center position within bore 15*a* and the spools are in their null position with respect to each other. In this position, main spool 12 is at a neutral position in bore 15*a* with land 60 sealingly engaging lands 36 and 31 and land 61 sealingly engaging lands 33 and 37. Accordingly, in this neutral position of main spool 12 in bore 15*a* there is no flow of fluid from the inlet passage 32 to either outlet passage 27 or 29. With spools 11 and 12 at null there is no flow of fluid from passage 32 through metering orifice 42 to either of chambers 20 or 21.

Figure 2:
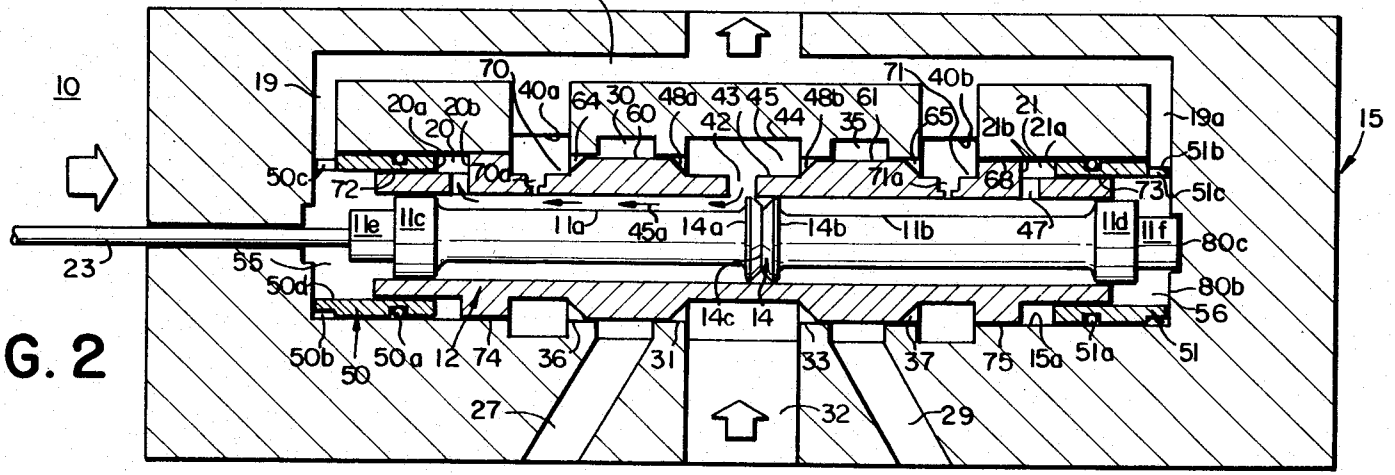

As shown in FIG. 2, when pilot spool 11 is moved to the right, metering land 14*a* disengages from the left wall of metering orifice 42 and fluid from inlet passage 32 flows through chamber 45, orifice 42 (flow 45*a*) and then through annular passage 11*a* and passage 46 to chamber 20. The pressure in this chamber 20 is effective between fixed wall 20*a* and moveable wall 20*b* to move wall 20*b* of main spool 12 to the right to the position shown in FIG. 3. As long as the opening between land 14*a* and the left wall of orifice 42 remains open, there is pressure applied to chamber 20 to move spool 12 to the right until that opening closes and spools 11, 12 are at null one with the other. In this position as shown in FIG. 3, spool 12 has moved out of the neutral or central position with respect to the lands in bore 15*a*. Specifically lands 61, 60 disengage from lands 33, 36 respectively. Therefore fluid from inlet passage 32 flows through chamber 45, metering groove 48*b*, groove 35 and then to cylinder line 25. In addition, return flow of fluid from cylinder line 24 flows through passage 27, recess 30, through metering groove 64 to return groove 40*a* and thence to tank.

It will now be understood that in this null position between spools 11 and 12, as shown in FIG. 3, there is a controlled flow through valve 10 in proportion to the movement of pilot spool 11 from the neutral position shown in FIG. 1. It is in this way that valve 10 provides an output hydraulic flow proportional to actuator 25 movement or to an electrical signal where the electrical signal is effective to move actuator 25 in a manner later to be described. In the control position shown in FIG. 3 with spools 11, 12 at null, there is no flow of fluid between the spools and thus there is avoided loss of energy which in prior systems would result from a continuous flow of fluid between the spools.

Figure 4:
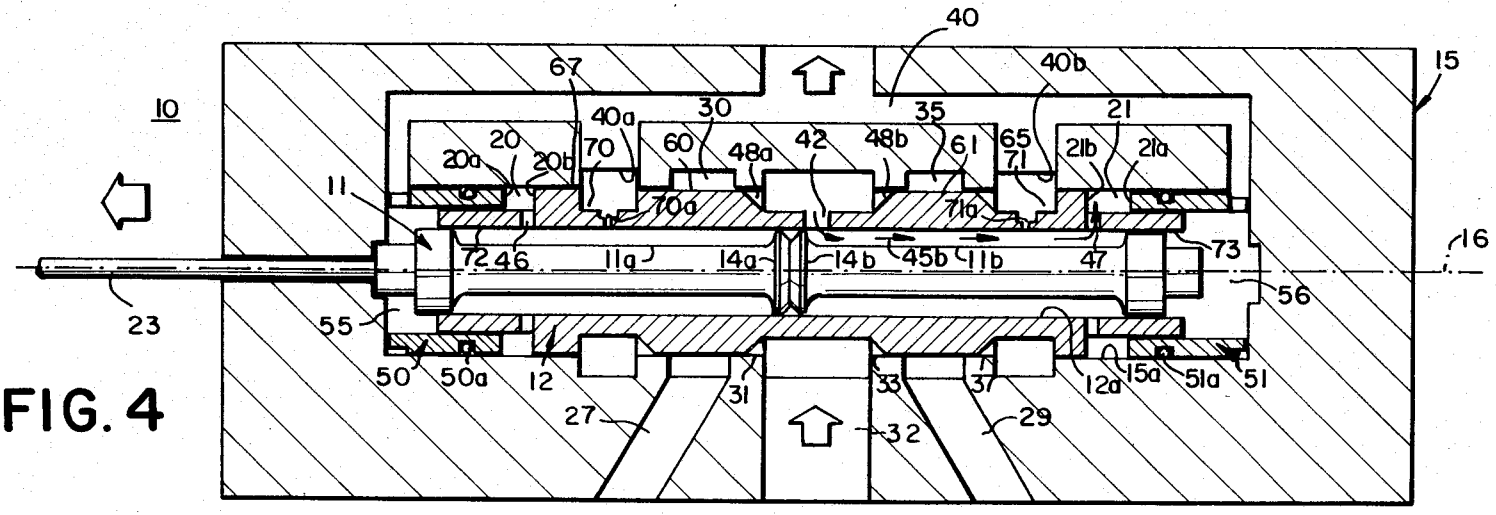
Figure 5:
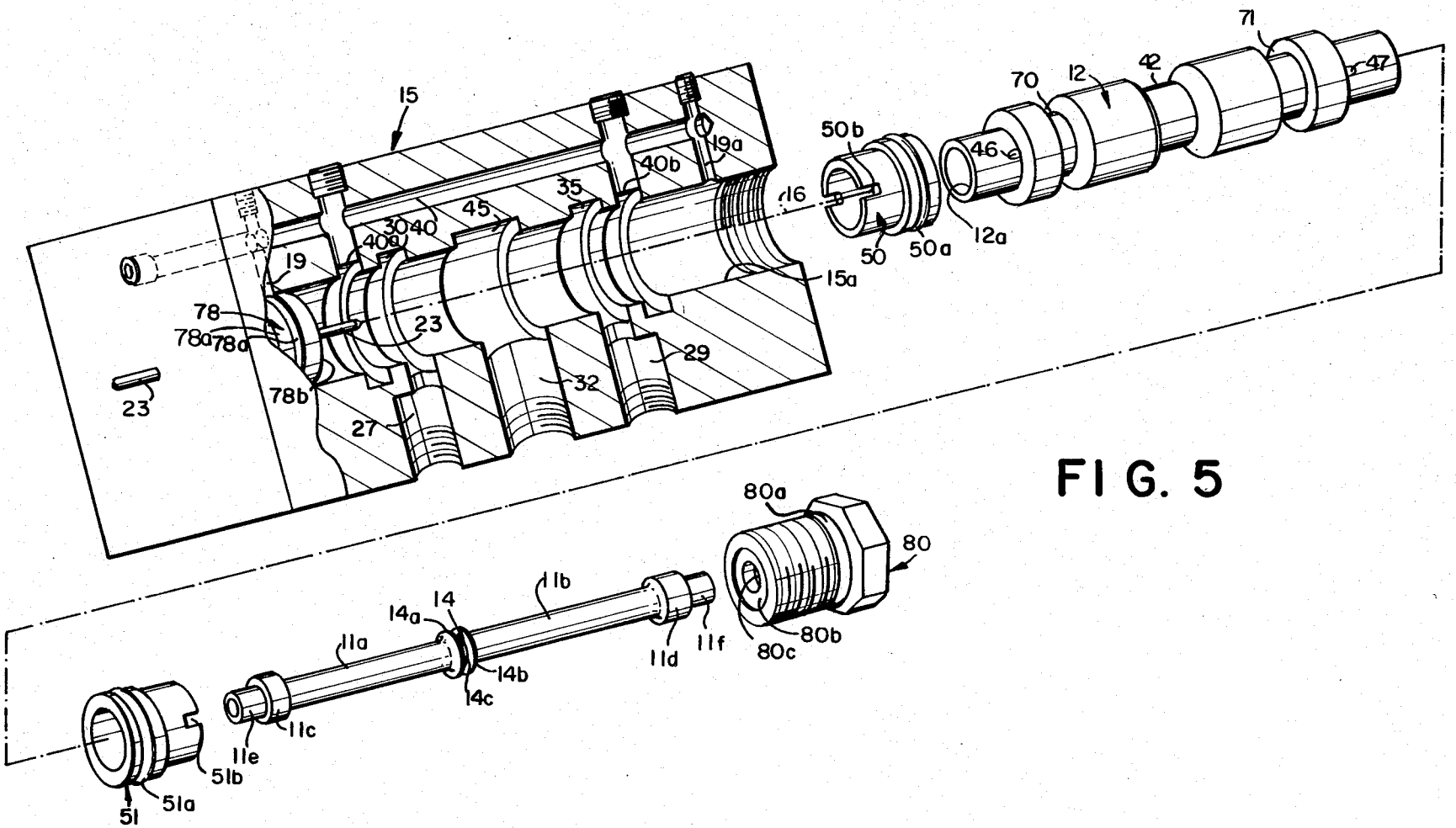
FIG. 5 is an exploded perspective view of the elements of FIGS. 1–4.

Another example of the movement of pilot spool 11 is shown in FIG. 4, in which main spool 12 is in its position shown in FIG. 1 and the pilot spool is moved to the left from its position in FIG. 1. Thus an opening is formed between land 14*b* and the right wall of orifice 42. Accordingly, fluid flow 45*b* may be traced from inlet passage 32, chamber 45, orifice 42, passage 11*b*, connecting passage 47 and thence to chamber 21. In the manner previously described, pressure on wall 21*b* is effective to move main spool 12 to the left until it reaches a null position with pilot spool 11 at its new control position. At this new control position (not shown) land 60 disengages from land 31 and land 61 disengages from land 37. Therefore fluid from inlet passage 32 flows past metering groove 48*a* to recess 30 and then through passage 27 to cylinder 22. Return flow of fluid takes place by way of line 25 to passage 29 and groove 35 and groove 65 to return 40*b*. It is in this way that valve 10 operates as a servo follower and proportional control valve.

It will be understood that in order to provide for fast precise response of valve 10 to the movement of pilot spool 11, it is preferred that each of end driving chambers 20 and 21 have a minimum fluid volume. For rapid response of valve 10 these chambers only require sufficient volume to provide the force required to move main spool 12 to overcome the flow effects on the main spool. One of these flow effects is shown in FIG. 3 as the flow from inlet 32 through chamber 45 and metering groove 48*b* to recess 35 and outlet passage 29. As well known by those skilled in the art, these flow effects comprise the Bernoulli effect as well as other effects of flow across main spool 12.

It will be seen that ring shaped chambers 20 and 21 are constructed having minimum volume by their provision, in one dimension, of having an outer diameter equal to bore 12*a* and an inner diameter equal to the outer diameters of recesses 72, 73 respectively. In the other dimension, chambers 20, 21 are constructed of minimum volume by means of the sidewalls of floating spacers 50, 51 respectively and lands 67, 68 respectively. It is in this manner that chambers 20, 21 operate effectively and each have substantially less volume than that of the spool end chambers 55, 56 respectively. More particularly, the drive area of chamber 20 defined by wall 20*b* is substantially less than the transverse solid or metal cross sectional area of main spool 12 itself at its largest diameter. That largest cross sectional area may be that taken at land 67 perpendicular to axis 16. The remaining cross sectional area defined by the end of section 72 is at return pressure in chamber 55. Similarly, wall 21*b* is of substantially less area than the largest solid cross sectional area of spool 12. The end of section 73 is at return pressure.

In addition, as previously described, spacers 50, 51 provide the walls of one side of chambers 20, 21 respectively without imposing side loads on the system. Spacers 50, 51 effectively float in main bore 15*a* and allow the ends of both spools 11, 12 in chambers 55, 56 to operate at tank or exhaust pressure. It is in this way that the ends of spools 11, 12 do not play any role in the movement.

It will be understood that driving chamber 20 is positioned adjacent the left end section of spool 12 between tank groove 40*a* and end chamber 55 also at tank or return pressure. In this manner, any minimal leakage from drive chamber 20 flows harmlessly to tank rather than flowing to and adversely affecting a control port such as port 30. Similarly, chamber 21 is between groove 40*b* and end chamber 56. Thus any leakage flows harmlessly to tank rather than adversely affecting control port 35. It is in this way that valve 10 does not require dynamic seals on spools 11 and 12. In this way, valve 10 rapidly follows rapidly changing step functions, for example, slow movements for accurate positioning resolution.

Further, annular passages 11*a*, 11*b* are sized to provide minimum volume passageways between orifice 42 and chambers 20, 21 thereby to minimize compressibility losses in the trapped volume.

It will be understood that if, in the example shown in FIG. 2, pilot spool 11 is moved rapidly to the right in a step movement of relatively large magnitude then passage 42 is completely opened. The resultant relatively large opening of orifice 42 allows a relatively large magnitude of flow of fluid from chamber 45 to chamber 20. Thus the resultant rapid step function of pressure developed in chamber 20 is effective to quickly move main spool 12 to the right in a direction to close that large opening. It is in this way there is produced an initial rapid change in pressure in chamber 20 which is effective to rapidly tend to close the opening of orifice 42. This rapid change in pressure decreases to a finite metering as passage 42 is closed. On the other hand if, in the example shown in FIG. 2, spool 11 were only moved a relatively small distance to the right, a small secant opening would only be provided between land 14*a* and the left wall of the orifice. The foregoing also applies for spool 11 movement to the left as in the example of FIG. 4. Thus only a finite movement of spool 12 to the right would be effected until that opening would be closed. Thus, valve 10 achieves high magnitude response to big step functions in the movement of pilot spool 11 and small magnitude response as the step function decreases.

Figure 6:
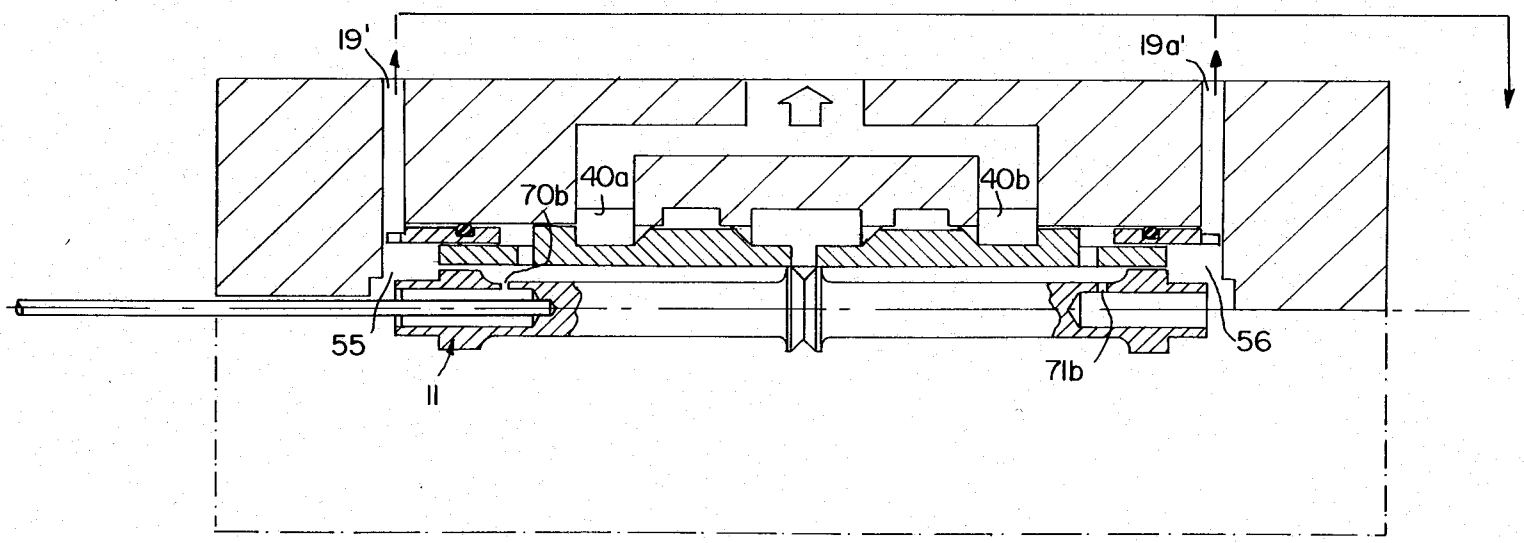
FIG. 6 is a simplified detailed elevational sectional view of another embodiment of the invention.

It will be understood that bleed orifice 70*a* is provided in order to bleed off fluid from chamber 20. This chamber is being compressed as in FIG. 4 when main spool 12 moves to the left. Similarly, bleed orifice 71*a* is provided to bleed off fluid from chamber 21 when this chamber is compressed by movement of spool 12 to the right as shown in FIGS. 2 and 3. The size of orifices 70*a*, 71*a* is a factor in determining the dynamics of the system of valve 10 since the compression of the respective chambers 20 and 21 is determined by the size of that orifice. In another embodiment of the invention as illustrated in FIG. 6, the flow from bleed orifices 70*a*, 71*a* (identified in FIG. 6 by reference numerals 70*b*, 71*b*) through return recesses 40*a*, 40*b* may be returned to tank separately from return passages 19, 19*a* (identified in FIG. 6 by reference numerals 19',19*a*'). Further, orifices 70*a*, 71*a* may be connected as indicated by reference numerals 70*b*, 71*b* through the center of spool 11 to respective end chambers 55, 56 which are in turn connected to tank.

It will further be understood that pilot spool 11 is pressure balanced so that it may be moved by a very light force applied to actuator 23. By pressure balance, it is meant that there is no spring biasing applied to pilot spool 11 and end chambers 55, 56 within which the pilot spool reciprocates and is balanced at tank or drain. Such a light force to actuator 23 may be applied by a digital drive motor such as a bidirectional linear actuator Series 9200 made by Airpax, Cheshire, Conn. 06410. Such a linear actuator provides a half a thousandths linear motion for each applied digital pulse. In this manner, for a digital input to the linear actuator, pilot spool 11 is accordingly moved and is accurately followed by main spool 12. It is in this way that valve 10 provides accurate and repeatable flow from pressure input 32 to cylinder ports 27, 29. In another example, actuator 23 may be moved manually or may be moved by a linear solenoid of the proportional or on/off type which is coupled to each end of spool 11.

We claim:

1. A proportional follower spool valve system for providing output fluid flow proportional to a positional control comprising:

a housing having a main passage with end chambers;

a main spool slidable in the main passage and having an inner passage and a cross-sectional area;

first fluid connections controlled by said main spool and effective to control the output fluid flow in accordance with the position of the main spool;

a pilot spool slidable in said passage;

means to move the pilot spool from a null position with the main spool in a first and a second direction in accordance with the positional control;

a first and second driving chamber formed by the main spool each having a driving area substantially less than the cross-sectional area of the main spool;

first and second elongated reduced diameter sections of the pilot spool extending to first and second lands constantly engaging the inner passage, the first and second lands fluidly isolating the first and second reduced diameter sections from the respective end chambers, the first and second reduced diameter sections fluidly coupled to the first and second driving chambers respectively for admitting fluid under pressure (1) to the first chamber when the pilot spool moves in the first direction away from the first chamber and (2) to the second chamber when the pilot spool moves in the second direction away from the second chamber, thereby to move the main spool in the same direction as the pilot spool until a null position is reached;

the pilot spool having first and second end inner passages opening into the respective end chambers;

and first and second bleed orifices fluidly coupled between respective first and second elongated reduced diameter sections and the first and second inner passages for bleeding off fluid (1) from the first chamber to return means separated from the first fluid connections when the main spool moves in the second direction and (2) from the second chamber to return means separated from the first fluid connections when the main spool moves in the first direction thereby to determine the frequency response of the system by the magnitude of the first and second bleed orifices.

2. The valve system of claim 1 in which said first and second driving chambers are formed on the main spool adjacent respective end sections thereof.

3. The valve system of claim 2 in which the first and second driving chambers are each formed on a reduced diameter section of the main spool and each having substantially less volume than an end chamber.

4. The valve system of claim 3 in which there is provided first and second floating nonmoving spacers, each disposed in a respective end chamber for slidably receiving therein the reduced diameter section and each forming one fixed wall of a respective driving chamber.

5. The valve system of claim 1 in which there is provided metering means fluidly coupled to the first and second elongated reduced diameter sections of the pilot spool, the metering means for admitting fluid under pressure: (1) to the first section when the pilot spool moves in the first direction; and (2) to the second section when the pilot spool moves in the second direction.

6. The valve system of claim 5 in which the metering means includes a V-groove having a pair of lands.

7. A proportional follower spool valve system for providing output fluid flow proportional to a positional control comprising:

a housing having a main passage with end chambers maintained at substantially return pressure;

a main spool slidable in said main passage and having an inner passage and a cross-sectional area;

first fluid connections controlled by said main spool and effective to control the output fluid flow in accordance with the position of the main spool;

a pilot spool slidable in said inner passage;

means to move the pilot spool from a null position with the main spool in a first and a second direction in accordance with the positional control;

a first and a second driving chamber formed by the main spool;

first and second elongated reduced diameter sections of the pilot spool extending to first and second lands constantly engaging the inner passage, the first and second lands fluidly isolating the first and second reduced diameter sections from the respective end chambers, the first and second reduced diameter sections fluidly coupled to the first and second driving chambers respectively for admitting fluid under pressure (1) to the first chamber when the pilot spool moves in a first direction away from the first chamber; and (2) to the second chamber when the pilot spool moves in a second direction away from the second chamber thereby to move the main spool in the same direction as the pilot spool;

the pilot spool having first and second end inner passages opening into the respective end chambers;

first and second bleed orifices fluidly coupled between respective first and second elongated reduced diameter sections and the first and second inner passages for bleeding off fluid (1) from the first chamber to return means separated from the first fluid connections when the main spool moves in the second direction and (2) from the second chamber to return means separated from the first fluid connections when the main spool moves in the first direction thereby to determine the frequency response of the system by the magnitude of the first and second bleed orifices.

8. The valve system of claim 7 in which each first and second driving chamber has a driving area substantially less than the solid cross sectional area of the main spool.

9. The valve system of claim 8 in which the first and second driving chambers are each formed on a reduced diameter section of the main spool adjacent respective end sections thereof and each having substantially less volume than an end chamber.

10. The valve system of claim 9 in which there is provided metering means fluidly coupled to the first and second elongated reduced diameter sections of the pilot spool, the metering means for admitting fluid under pressure: (1) to the first section when the pilot spool moves in the first direction; and (2) to the second section when the pilot spool moves in the second direction.

11. The valve system of claim 10 in which there is provided first and second floating nonmoving spacers, each disposed in a respective end chamber for slidably receiving therein the reduced diameter section and each forming one fixed wall of a respective driving chamber.

* * * * *